United States Patent [19]

Walker et al.

[11] Patent Number: 4,550,228

[45] Date of Patent: Oct. 29, 1985

[54] RIBBON SPEAKER SYSTEM

[75] Inventors: Gary E. Walker, Dover; Leo Spiegel; Anthony J. Shuman, both of Sharon; James L. Kirtley, Jr., Brookline, all of Mass.

[73] Assignee: Apogee Acoustics, Inc., Randolph, Mass.

[21] Appl. No.: 468,509

[22] Filed: Feb. 22, 1983

[51] Int. Cl.[4] ..... H04K 9/06; H04K 1/24; H04K 7/06

[52] U.S. Cl. ..... 179/115 V; 179/115.5 PS; 179/115.5 PV; 179/116

[58] Field of Search ..... 179/115.5 PS, 116, 146 E, 179/115.5 PV, 115 V

[56] References Cited

U.S. PATENT DOCUMENTS

| | | | |
|---|---|---|---|
| 1,726,105 | 8/1929 | Harrison | 181/166 |
| 2,233,886 | 3/1941 | Cowley et al. | 179/115 V |
| 2,404,798 | 7/1946 | Harry et al. | 179/115.5 R |
| 2,673,251 | 3/1954 | Duncan | 179/115 V |
| 3,013,905 | 12/1961 | Gamzon et al. | 179/115.5 PV |
| 3,066,200 | 11/1962 | Pavlak | 179/115.5 PV |
| 3,164,686 | 1/1965 | Tibbetts | 179/115.5 PV |
| 3,564,163 | 2/1971 | Hobrough | 179/115 V |
| 3,674,946 | 7/1972 | Winey | 179/115.5 PV |
| 3,919,499 | 11/1975 | Winey | 179/115.5 PV |
| 4,049,926 | 9/1977 | Kasatkin et al. | 179/115 V |
| 4,156,801 | 5/1979 | Whetan et al. | 179/115.5 PV |
| 4,273,968 | 6/1981 | Suyama | 179/115.5 PV |
| 4,317,966 | 3/1982 | Lister | 179/115 V |
| 4,319,096 | 3/1982 | Winey | 179/115 V |
| 4,395,592 | 7/1983 | Colangelo | 179/115 V |

FOREIGN PATENT DOCUMENTS

| | | |
|---|---|---|
| 8102501 | 9/1981 | European Pat. Off. . |
| 0065808 | 12/1982 | European Pat. Off. . |
| 1184382 | 12/1964 | Fed. Rep. of Germany . |
| 2558492 | 7/1976 | Fed. Rep. of Germany . |
| 609853 | 4/1926 | France . |
| 209761 | 9/1924 | United Kingdom . |
| 674470 | 6/1952 | United Kingdom . |
| 810064 | 3/1959 | United Kingdom . |

OTHER PUBLICATIONS

*The Journal of the Acoustical Society of America*, "Non--Linear Distortion in Dynamic Loudspeakers Due to Magnetic Effects", Cunningham, vol. 21, No. 3, May 1949, pp. 202-207.

*Primary Examiner*—Gene Z. Rubinson
*Assistant Examiner*—Danita R. Byrd
*Attorney, Agent, or Firm*—Wolf, Greenfield & Sacks

[57] ABSTRACT

The speaker system consists of a single housing containing a tweeter, mid-range and woofer transducer units. The tweeter unit consists of an elongated, aluminum ribbon positioned vertically and connected to the top and bottom of a rigid elongated frame. The ribbon is located between sets of split magnets which are designed to provide a shaped magnetic field that helps center the ribbon in a direction perpendicular to its length. Additional electromagnetic centering is provided by flat ribbon conductors located on the surfaces of the magnets sets which return the current carried by the ribbon. The mid-range transducer is similar to the tweeter transducer in construction except that the edges of the mid-range ribbon are mechanically attached to the frame by foam strips. In addition, the mid-range ribbon is transversely corrugated at variable slant angles relative to ribbon longitudinal axis. The woofer transducer consists of an elongated, trapezoidal, corrugated aluminum ribbon attached to a non-vibrating frame. In order to provide a single electrical path, the ribbon is divided into a serpentine path by a series of cuts. To prevent undesirable auto effects, the ribbon is tensioned in a transverse direction.

25 Claims, 11 Drawing Figures

RIBBON SPEAKER SYSTEM

FIELD OF THE INVENTION

The present invention relates to acoustic transducer systems and, in particular, to ribbon speaker systems.

BACKGROUND OF THE INVENTION

At present, there are many types of acoustical transducer or loudspeaker arrangements designed to accurately reproduce sounds in high-fidelity sound systems. The most familiar type of such transducers is the well-known cone speaker which produces sound energy by vibrating a cone-shaped transducer element by means of an electromagnetic voice-coil arrangement. Various modifications of this arrangement have been developed including acoustic suspension speakers, motional feedback speakers and other arrangements to reduce distortion and improve fidelity of the reproduced sound.

One of the major disadvantages with cone speakers is that, due to their physical construction, they must be driven over a narrow ring-shaped area. This type of drive induces unwanted structural vibrations in the cone and causes distortion. In addition, most cone speakers have limited dispersion. That is, the sound quality perceived by a listener located in a room with such a speaker changes when the listener moves about the room. In order to increase the dispersion of a cone speaker it is necessary to make the physical size of the speaker cone as small as possible so that the speaker acts as a "point" source. Unfortunately, small speakers have limited power handling capability.

Loudspeakers employing metallic ribbons and plastic or paper diaphragms to reproduce sounds are also well-known in the art and have been demonstrated to have advantages compared to the cone speakers. In particular, such speakers may have better dispersion characteristics than the cone speakers for a given power handling capability because they approximate a "line" source rather than a "point" source. Unfortunately, due to the mechanical characteristics of the metallic ribbons and non-metallic panels and unfortunate acoustical design, such speakers often have mechanical resonances or other distortions which prevent the speakers from producing an accurate reproduction of the sound with high resolution over the full acoustic frequency range normally encountered during high-fidelity sound reproduction. For example, such speakers are often subject to a phenomenon known as "diffraction" which occurs when, due to poor speaker design, the speaker acts as a multiple line source instead of a single line source. In addition, the non-metallic materials used to fabricate panel speakers were subject to deterioration with age due to stretching of the speaker materials.

In order to achieve good frequency response, especially in mid-range frequencies, it has been found necessary to use a long, narrow lightweight ribbon. Prior art ribbon midrange tweeter designs have been unable to properly align such a ribbon with the speaker's magnetic field and to keep the ribbon centered within its supporting frame for relatively high power levels. Previous prior art ribbon designs have not demonstrated the capability to reproduce music at lifelike sound power levels.

In addition, prior art midrange ribbon transducer designs have not been able to minimize the acoustical leakage around the sides of the ribbon or provide for the proper electrical and dynamic characteristics of the acoustical ribbon element.

Further, prior art ribbon systems have often utilized classical cone-type woofers instead of ribbon woofer elements due to problems encountered in the design of large area ribbons necessary for good low-frequency response. The cone-type woofers were subject to the distortion and dispersion problems set forth in detail above.

Therefore, it is an object of the present invention to provide a speaker system which provides accurate, high-resolution reproduction of sound over the full acoustic frequency range normally encountered in sound reproduction systems.

It is a further object of the present invention to produce a speaker system with excellent dispersion over the full acoustic frequency range.

It is yet a further object of the invention to produce a ribbon speaker system which is easily constructed from readily available materials.

It is yet another object of the invention to produce a ribbon speaker system which eliminates the mechanical resonances and distortions typically found in prior art cone, planar and ribbon speakers.

It is yet a further object of the present invention to provide a speaker system in which the transducers are not subject to deterioration with age.

It is still another object of the invention to provide a speaker system with means for automatic centering of the speaker ribbons within their supporting framework.

It is still another object of the invention to provide a speaker system with a wide bandwidth frequency response.

It is yet another object of the invention to provide a tweeter transducer which acts like a theoretical "line source".

It is a further object of the invention to provide a line source tweeter transducer which utilizes only a single common magnetic structure and no back wave damping materials.

SUMMARY OF THE INVENTION

The foregoing problems are solved and the foregoing objects are achieved in one illustrative embodiment of the invention in which a ribbon speaker system consists of an integrated three element acoustic transducer for reproducing high, mid-range and bass sounds. The tweeter element consists of a single, narrow, elongated, horizontally-corrugated aluminum ribbon positioned vertically and connected to the top and bottom of a rigid, elongated frame. The aluminum ribbon is located between sets of magnets which are designed to provide a shaped magnetic field that provides magnetic centering of the ribbon. The ribbon is driven by action of an alternating current which interacts with the shaped magnetic field. Additional electromagnetic containment for the transducer ribbon is provided by electrical current passing through the ribbon which current returns to its source by means of flat ribbon conductors located on the surfaces of the magnet sets. In another embodiment of the tweeter transducer, the sound generating element consists of two narrow, elongated ribbons mounted parallel to each other and spaced a small distance apart. The ribbons are connected electrically so that the alternating current flows through the ribbons in opposite directions causing the ribbon pair to act as a line source.

The mid-range element consists of an single elongated corrugated aluminum ribbon mounted vertically in a rigid elongated frame in a similar fashion to the tweeter element. However, in the mid-range unit the ribbon corrugations are fabricated at variable slant angles relative to the longitudinal axis of the ribbon. The ribbon is also acoustically sealed along its sides to the frame to minimize acoustical leakage.

The woofer element consists of a broad elongated, trapezoidal-shaped, horizontally corrugated aluminum ribbon that is supported on all sides and mounted vertically in a rigid, elongated frame. To provide a single electrical path through the ribbon it is divided by a series of horizontal cuts into a serpentine pattern. The ribbon is located directly in front of a rectangular array of ceramic magnets mounted on a steel backing sheet.

DETAILED DESCRIPTION

Figure 1:
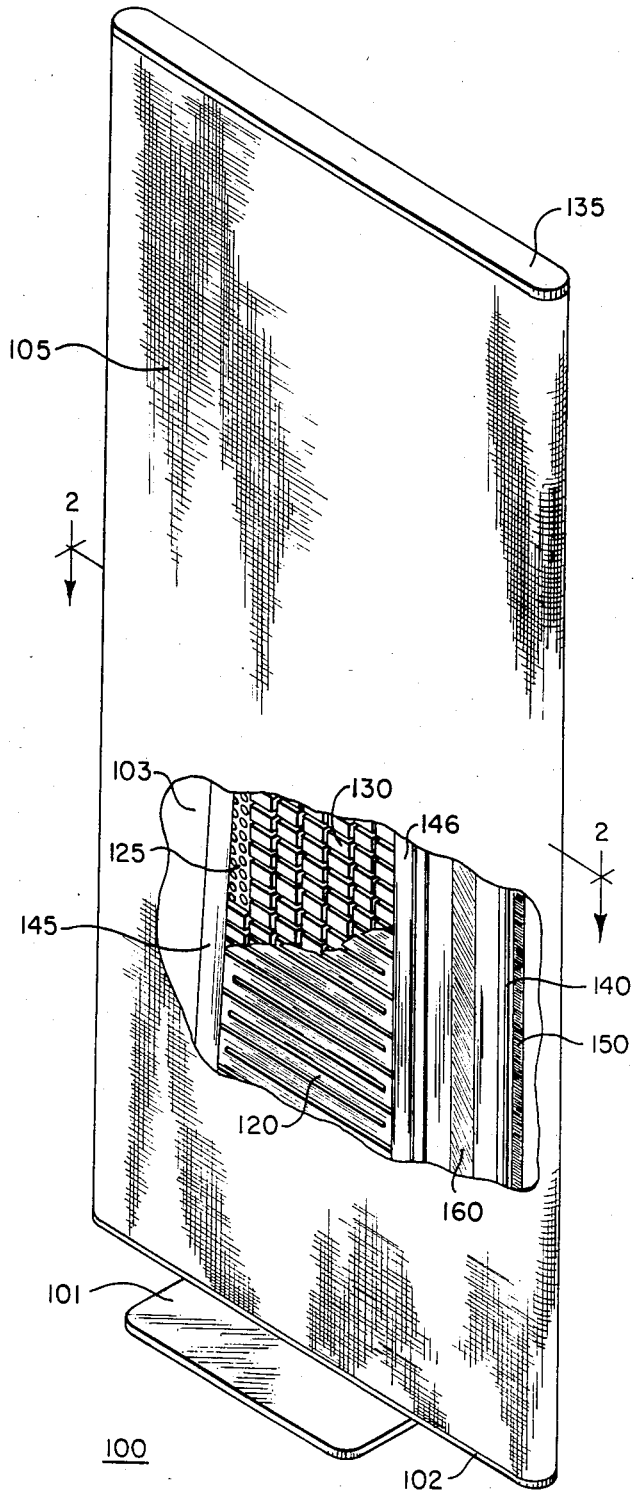
FIG. 1 shows an isometric view of the integrated three element ribbon transducer with a cut-away portion illustrating the placement of the magnets and ribbons.

A perspective view of an illustrative three-element transducer suitable for use in the inventive ribbon speaker system is shown in FIG. 1. Transducer 100 has a generally planar shape and is mounted upright on flat base member 101. Transducer 100 is only a single transducer; for a conventional stereophonic sound reproduction system, two transducers would be placed at separate points in the listening area. When two transducers are used their mechanical construction is nearly identical with the exception of symmetrical changes in ribbon element shape as will be discussed in more detail hereinafter.

An illustrative size for transducer unit 100 is approximately 80 inches tall and approximately 36 inches wide. The mechanical structure of the woofer portion of the unit consists of two upright support members (not shown in FIG. 1) which are structurally attached to the bottom member 102 and to top member 135. One support member is perpendicular to the base 102 and the other support member is mounted at an angle to base member 102. A stretcher element 145 is mounted on one upright support member and another stretcher element 146 is mounted on the other upright support member, respectively.

A thin, aluminum ribbon 120 of trapezoidal shape, which conducts a current varying in proportion to the audio frequencies to be reproduced, is attached on each vertical edge to a respective stretcher element and held in tension between stretcher elements by a spring mechanism (not shown). Ribbon element 120 is supported in a magnetic field produced by a trapezoidal array of permanent magnets 130 mounted on a backing plate 125 attached to the support members. Actual sound generation by the woofer transducer is produced by audio-frequency vibrations of ribbon 120 caused by D' Arsonval forces in turn created by an interaction of the current running in ribbon 120 with the magnetic field produced by magnet array 130. Transducer 100 is covered with acoustically-transparent fabric 105 to improve appearance and to help protect ribbon element 120 (In FIG. 1, a portion of fabric 105 has been cut away from the front of transducer 100 to reveal the internal construction). Detailed construction of the woofer magnet array and transducer ribbon are shown in FIGS. 3–6 inclusive.

Figure 8:
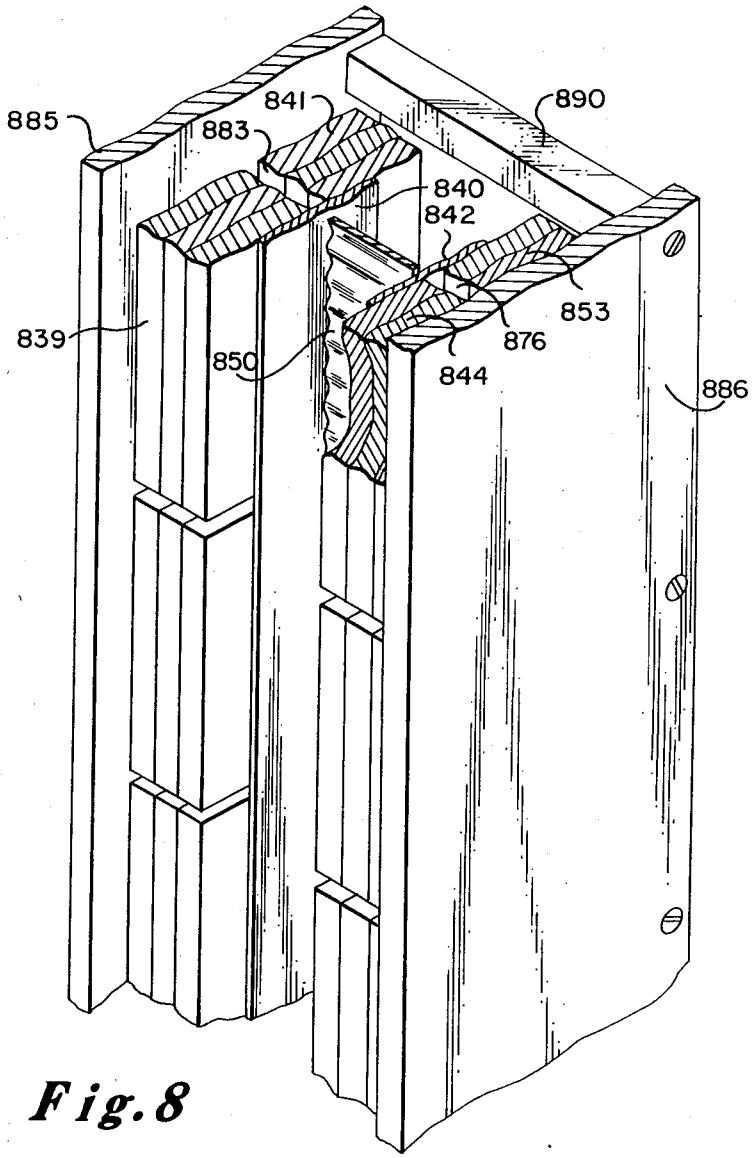
FIG. 8 shows an enlarged isometric sectional view of the tweeter transducer.

Also shown in FIG. 1 are the mid-range and tweeter transducer units suitable for use with the illustrative embodiment of the inventive speaker system. Each tweeter transducer consists of two side plates (only plate 140 is shown in FIG. 1) bearing two sets of magnets which establish a magnetic field between them. Located between the two sets of magnets is an narrow rectangular ribbon transducer 150 which is made of a light gauge tempered aluminum with horizontal corrugations. The top and bottom ends of the ribbon are attached to the side plates as will be hereinafter described. The vertical edges of ribbon 150 are not attached to the support. Construction details of the magnet array and ribbon are shown in FIG. 8.

Figure 7:
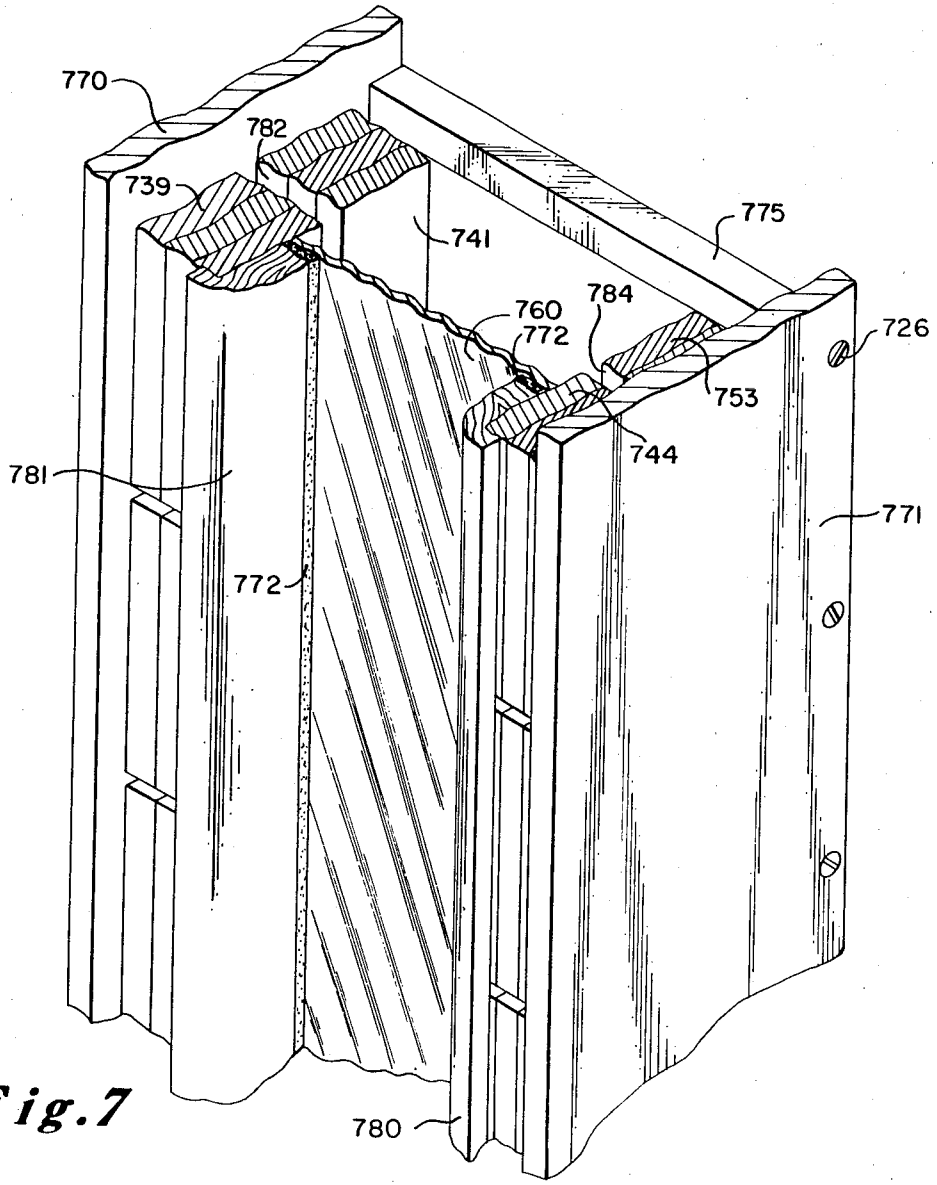
FIG. 7 is an enlarged isometric sectional view of the midrange transducer.

The midrange transducer unit also consists of two side plates (not shown in FIG. 1) bearing two sets of magnets which establish a magnetic field between them. Located between the two sets of magnets is an narrow rectangular ribbon transducer 160 which is made of a light gauge tempered aluminum. The top and bottom ends of the ribbon are attached to side plates (as with the tweeter ribbon) as will hereinafter be described. However in contrast to the tweeter element, the vertical edges of the mid-range element are fastened to the vertical side plates by acoustical foam. In addition, the ribbon is corrugated at an angle to its longitudinal axis rather then horizontally. Construction details of the mid-range magnet array and ribbon are shown in FIG. 7.

The transducer assembly is completed by an "ear" 103 which is located next to the woofer transducer and serves as an acoustic baffle.

Figure 2:
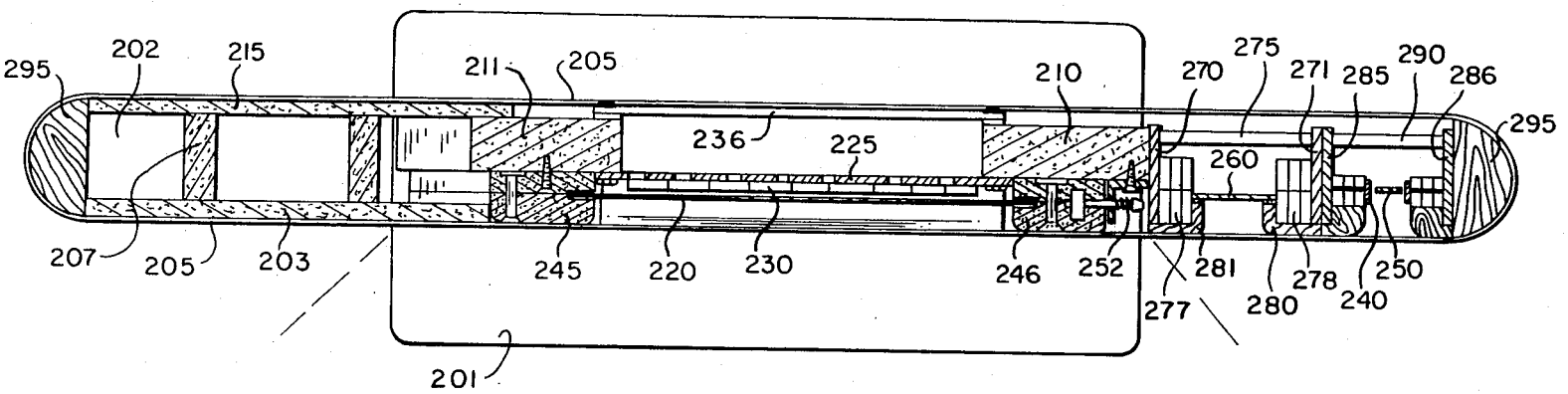
FIG. 2 shows a cross-section of the speaker at sections lines 2—2 in FIG. 1.

FIG. 2 of the drawing shows a sectional view of the three-element transducer taken at the line 2—2 in FIG. 1. Bottom member 202 and the top member (not shown) each consist of a piece of sheet steel approximately 3/16" by 3" by 35" in length and are used to hold the various speaker elements in position. Mounted on bottom member 202 are the main support members 210 and 211 comprised of 1" wood particle board or other suitable material. Support members 210 and 211 are approximately four inches by one inch in cross-section and are held in a fixed spatial relationship by backing plate 225 (which is bolted to the front of each support member)

and nine back braces, 236, of 1"×3/16" steel which are bolted to the back of support members 210 and 211. Two of the strips run vertically along support members 210 and 211 and the rest run horizontally between the members with equidistant spacing. Backing plate 225 is a planar, trapezoidal-shaped steel plate of 0.105 inch thickness which extends over the entire height of the transducer. It is uniformly perforated with ¼-inch perforations.

Cemented to the outside face of backing plate 225 with epoxy cement is an array of permanent magnets 230. Each of these magnets consists of a barium-strontium ferrite ceramic magnetic material and is approximately 2.5 by 0.75 by 0.44 inches thick. Magnets 230 are mounted on backing plate 225 with their north/south axis perpendicular to the plane of plate 225. In addition to providing physical support, plate 225 also provides a path of low magnetic reluctance to complete the magnetic circuit. Across each magnet row, the individual magnets are mounted in a consistent relationship so that a north pole or a south pole occurs across the width of the magnetic array (shown in detail in FIG. 6). The magnet pole positions in each magnet row are reversed in the magnets in the rows vertically above and below it (shown in detail in FIG. 6). This magnet arrangement creates a series of horizontal magnetic field patterns with vertically alternating magnetic field direction.

Sound-generating ribbon element 220 consists of a corrugated aluminum ribbon which is supported on all four sides. In particular, as shown in FIG. 2, ribbon 220 is held in tension between two stretcher members 245 and 246. Member 245 is permanently mounted to support 211. Member 246, however, slides along the face of support 210 and can be held in tension by means of tensioning screws and springs 252.

Located next to the woofer transducer are the mid-range transducer and the tweeter transducer. Both transducers consist of similar construction. The mid-range transducer consists of a supporting frame and parallel rows of magnets. The supporting frame, in turn, consists of side plates 270 and 271 which are held rigidly separated by a plurality of 19 braces, 275. Attached, by epoxy cement, to plates 270 and 271 are sets of magnets 277 and 278, respectively. Magnet sets 277 and 278 establish the magnetic field which interacts with the current running in ribbon 260 to generate sound producing vibrations. In order to prevent acoustical energy from escaping around ribbon 260, the vertical edges of ribbon 260 are cemented to corner pieces 280 and 281.

The tweeter transducer also consists of a supporting framework comprised of plates 285 and 286 held separated by braces 290. In contrast to the mid-range transducer, however, the edges of ribbon 250 are not attached to a side-supporting structure. In addition, ribbon 250 is much narrower than ribbon 260.

The transducer unit is also provided with an ear or baffle unit comprised of members 203 and 215 and separator 207 which unit prevents sound energy emanating from the rear of the woofer unit from interferring with sound energy projected from the front of the transducer. The baffle extends the bass response of the transducer to lower bass frequencies and can be illustratively comprised of wood or particle-board material. A wooden end cap, 295, is mounted at each end of the transducer to provide a smooth corner and an attractive appearance. As previously mentioned, the entire transducer unit is covered with acoustical speaker fabric 205 to improve its appearance.

Figure 3:
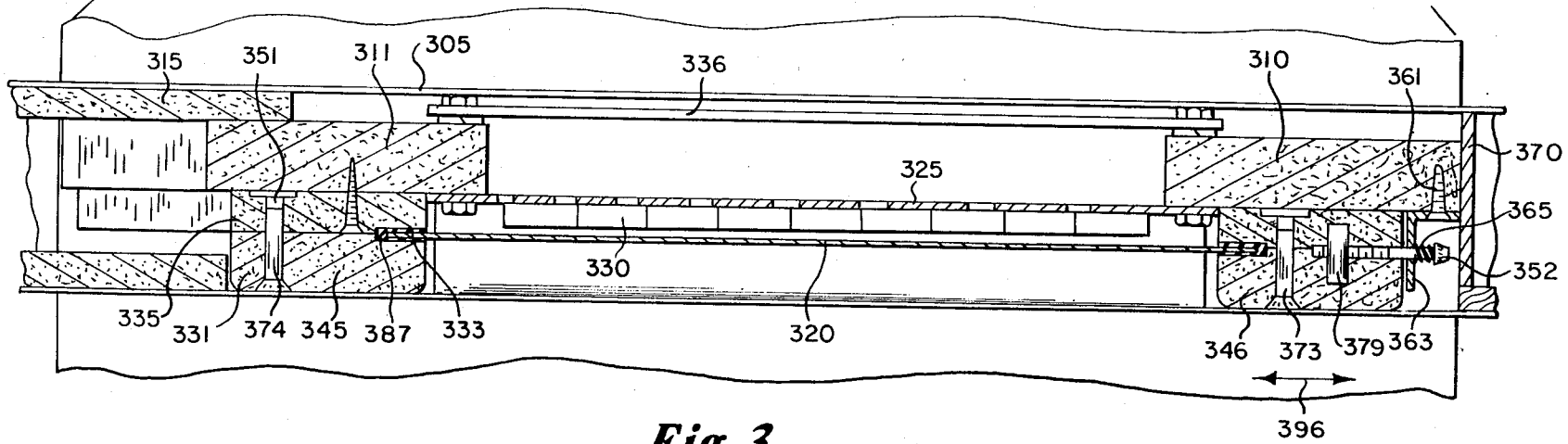
FIG. 3 is an enlarged view of the woofer section of FIG. 2.

FIG. 3 shows an expanded diagram of the construction of the acoustical transducer members. In particular, FIG. 3 shows support members 310 and 311 which, as previously mentioned are rigidly separated by backing plate 325 and back braces 336. Also shown are stretcher members 345 and 346 which are used to support and tension ribbon element 320. Stretcher member 345 is comprised of two wooden strips 331 and 335, having a rabbet 387 cut in each. Strip 335 is permanently attached to support 311 by glue and screws. Strips 335 and 331 are bolted together by bolts 374 and "T-nuts" 351 at regular intervals. When strips 335 and 331 are fastened together, the opposing rabbets from a slot to hold a U-shaped strip of soft foam 333. Ribbon 320 is fastened between strips 335 and 331 by silicone rubber adhesive. Strip 331 has a rounded corners to reduce diffraction of sound waves produced by ribbon 320 which can be caused by sharp edges in the vicinity of the ribbon.

Stretcher member 346 is similarly composed of two wooden pieces bolted together by T-nut 373, forming a clamp into which is inserted transducer ribbon 320. Stretcher unit 346, however, is not fastened to support member 310 but is free to move in a direction of arrow 396. Ribbon 320 is held under tension by means of a screw arrangement which forces structure member 346 to the right in FIG. 3. In particular, a metal angle iron 363 is mounted to main support 310 by means of screws 361. Angle iron 363 has a hole drilled in it through which is inserted tensioning bolt 352 and tensioning spring 365. A plurality of tensioning bolts is spaced evenly along the edge of stretcher member 346. Each of the bolts 352 threads into a corresponding barrel nut 379 which is recessed into stretcher member 346. After the transducer unit has been assembled, bolts 352 are tightened to compress tensioning springs 365 which, in turn, provide a uniform horizontal tension to ribbon 320. Springs 365 insure that the ribbon will maintain its originally-manufactured frequency response despite small changes in the supporting structure. To prevent stretcher 346 from moving away from support 310, a plurality of holes (not shown) are drilled through stretcher 346. Through these holes screws are inserted into support 310. A rubber grommet around each screw allows the tension adjustment to be made after stretcher member 346 is attached to support 310.

Figure 6:
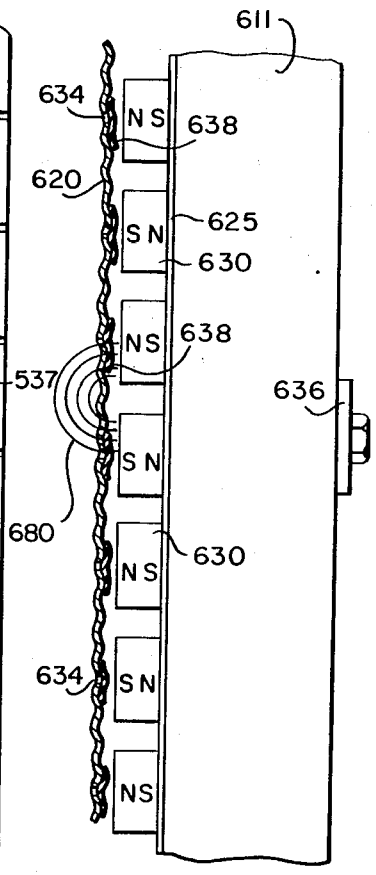
FIG. 6 is a cross-section enlarged view of the woofer transducer taken along line 6—6 in FIG. 4.
Figure 5:
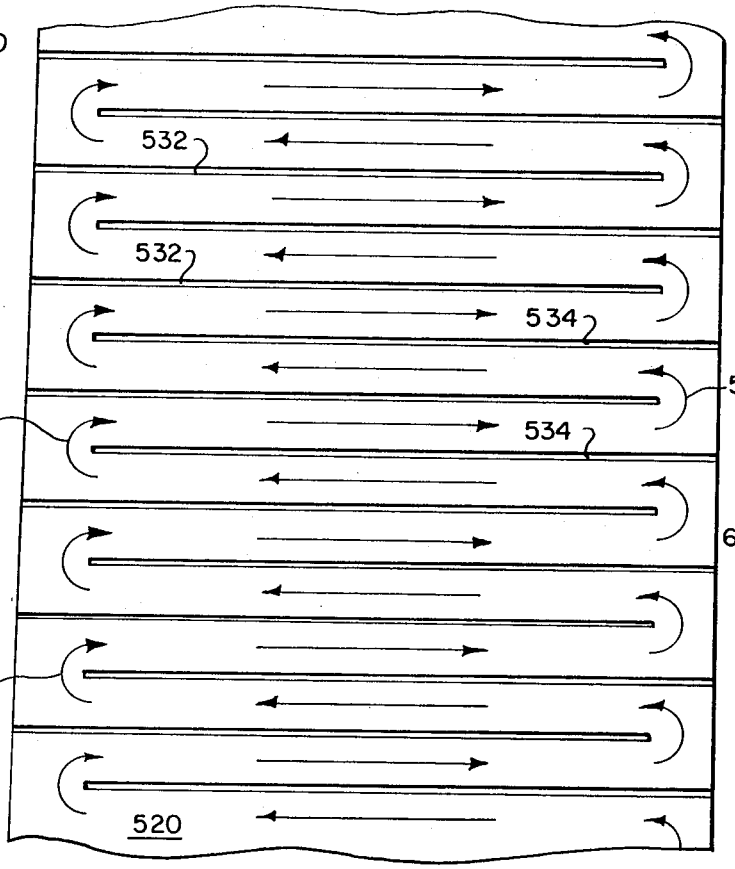
FIG. 5 is an enlarged view of the woofer ribbon showing the placement of the horizontal cuts.

FIG. 3 also shows in more detail the orientation of magnets 330 which are cemented to backing plate 325. The magnetic axis of each magnet is arranged to be perpendicular to backing plate 325 and the magnets are arranged with north and south poles as is shown in FIG. 6 to produce a magnetic force field as shown at 680.

Figure 4:
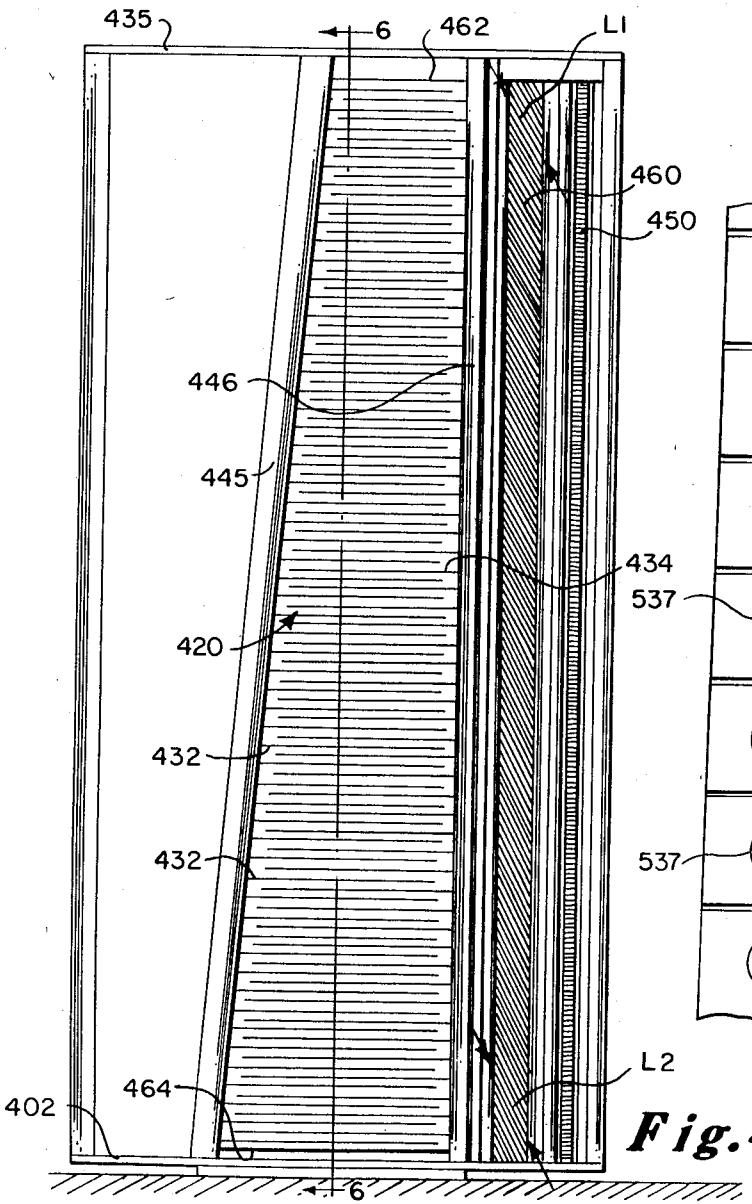
FIG. 4 is a front view of the three-element transducer with the acoustic cover removed to expose the ribbons and supporting frame arrangement.

FIG. 4 shows a plan view of the three-element transducer showing in detail the shape of the inventive sound-generating ribbon. In particular, in accordance with the invention, ribbon 420 has a trapezoidal shape which is approximately 10 inches wide at its top 462 and 14 inches wide at its bottom 464. Ribbon 420 is slightly corrugated at approximately 0.200 inch intervals to produce corrugations with approximately 0.060 inch height peak-to-peak in order to increase the pliability of the ribbon material. The trapezoidal shape of the ribbon distributes its natural frequency resonances over a wider frequency band than the frequency band of a simple rectangular ribbon.

Ribbon 420 is mounted in a trapezoidal frame consisting of support members 445 and 446, base 402 and top member 435. As previously mentioned, ribbon 420 is supported and tensioned between stretcher members 445 and 446. FIG. 4 shows a transducer unit which would be used as the left transducer in a two transducer sound system. The right transducer would be identical in construction to the left transducer except that it is a mirror image.

Ribbon 420 has a plurality of narrow horizontal, alternating slots 432, 434 which divide it into a single electrical current path. In particular, as shown in more detail in FIG. 5, a plurality of equally-spaced narrow slots 534 are provided which extend horizontally from the right side of ribbon 520 nearly to the the left side. Interspersed with slots 534 are a plurality of horizontal slots 532 which extend horizontally from the lefthand side of ribbon 520 nearly to the righthand side. These slots divide the entire ribbon surface into a single serpentine current path in which the current follows arrows 537 (during the negative half cycle of the alternating current drive current flows in the reverse direction to arrows 537). Slots 532 and 534 ensure that the current will follow a plurality of substantially horizontal paths to ensure proper interaction with the magnetic field produced by the magnet array located directly behind the ribbon.

Also shown in FIG. 4 are the mid-range ribbon 460 and the tweeter ribbon 450. Mid range ribbon 460 is approximately 2.2 inches wide and is also corrugated at 0.2 inch intervals. These corrugations are at a variable angle to the vertical axis of the ribbon. Specifically, the slant angle of the corrugations varies uniformly over the length of the ribbon so that the flute length L1 at the top of the ribbon is approximately 12 inches and the length L2 at the bottom of the ribbon is $8\frac{1}{2}$–9 inches.

Tweeter ribbon 450 is approximately 0.5 inches in width and is uniformly corrugated horizontally at 0.1 inch intervals.

FIG. 6 shows a vertical section of the ribbon and magnet array, in particular showing slots 634 in ribbon 620. Pieces of tape 638, (preferably Mylar tape) is placed over each slot to provide mechanical integrity for the ribbon. As shown in FIG. 6, slots 634 are physically located with respect to magnet rows 630 so that the horizontal current-carrying portions of ribbon 620 are located over the gaps between magnet rows where the magnetic field is strongest. The current direction reversals caused by slots 634 correspond to the magnetic field reversals which are caused by the reversed pole positions in alternate magnet rows as shown in FIG. 6. This arrangement insures that the entire ribbon moves in the same direction simultaneously. FIG. 6 also shows the location of braces 636 bolted to support 611. Magnets 630 are cemented on backing plate 625 at 2 inch intervals.

FIG. 7 shows an isometric section of the illustrative mid-range transducer. The main components of the mid-range unit are ribbon 760 and its supporting frame. Ribbon 760 is an elongated rectangular tempered aluminum ribbon of approximately 0.7 mil thickness, 80 inch length and 2.2 inch width. Ribbon 760 is corrugated across its width at approximately 0.2 inch intervals with corrugations of approximately 0.1 inches peak-to-peak. As previously described the corrugations are at a variable angle relative to the vertical axis of the ribbon in order to provide a variable spring support in line with the acoustical drive and to provide mechanical crosswise stiffness. The magnet supporting structure is formed of flat steel side pieces 770 and 771 approximately 3 inches wide by 3/16 inches thick. Side pieces 770 and 771 are rigidly secured at approximately a 4.5-inch spacing by 19 spacer bars 775 spaced equally over the height of the transducer (approximately 4-inch intervals). Spacer bars 775 are constructed of a magnetic material and provide a return path for the magnetic field generated by the magnets 739, 741, 744 and 753 in addition to providing mechanical spacing. Each end of bars 775 is threaded to accept a cap screw 726 in order to secure the bars to the side plates 770 and 771.

A set of magnets 739 and 741 are mounted on the inside face of side plate 770 as shown in FIG. 7. Each magnet set is comprised of three magnets, each of which, in turn, consists of barium-strontium ferrite ceramic magnetic material and is approximately $1\frac{7}{8}$ by $\frac{7}{8}$ by $\frac{3}{8}$ inches in size. The magnets are spaced uniformly along the height of the transducer.

In accordance with the invention, magnet pair 739 and 741 are separated by an air gap or other suitable non-magnetic spacer 782. Spacer 782 is approximately $\frac{1}{8}$ inch in thickness and helps to shape the magnetic field produced by magnets 739 and 741 which shaping, in turn, helps to keep ribbon 760 physically centered.

Attached to side member 771 are also two magnet sets, 744 and 753 arranged in a similar fashion to magnets 739 and 741 with the exception that the poles of opposite polarity face ribbon 760. Magnets 744 and 753 are also separated by a non-magnetic spacer or gap 784.

Two wooden strips 780 and 781 are mounted on the lateral faces of the magnets to provide anti-diffraction exit shapes which minimize the effects of diffraction which can occur at any sharp corners located in the vicinity of sound-generating ribbon 760. To prevent acoustic energy from leaking around ribbon 760 the vertical edges of the ribbon are affixed to strips 780 and 781. In particular, ribbon 760 is attached to the inside edges of strips 780 and 781 means of pressure-sensitive-adhesive covered foam strips 772.

FIG. 8 shows an isometric section of the illustrative tweeter transducer. As with the mid-range unit, the main components of the tweeter unit are ribbon 850 and its supporting frame. Ribbon 850 is an elongated rectangular tempered aluminum ribbon of approximately 0.5–0.7 mil thickness, 80 inch length and $\frac{1}{2}$ inch width. Ribbon 850 is corrugated across its width at approximately 0.1 inch intervals with corrugations of approximately 0.030 inches peak-to-peak to provide a soft spring support in line with the acoustical drive to to provide mechanical crosswise stiffness. The ribbon supporting structure is formed of flat steel side pieces 885 and 886 approximately 2 inches wide by 3/16 inches thick. Side pieces 885 and 886 are rigidly secured at a fixed $2\frac{3}{8}$ inch spacing by 13 spacer bars 890 spaced equally over the height of the transducer. Spacer bars 890 are constructed of a magnetic material and provide a return path for the magnetic field generated by the magnets 839, 841, 844 and 853 in addition to providing mechanical spacing. Bars 890 are attached to side plates 885 and 886 in the same manner as the mid-range transducer.

Two sets of magnets 839 and 841 are mounted on the inside face of side plate 885 as shown in FIG. 8. Each of these magnet sets consists of three magnets, each, in turn, consisting of barium-strontium ferrite ceramic magnetic material and approximately 1 by $\frac{1}{2}$ by $\frac{1}{4}$ inches in size. The magnets are spaced uniformly along the height of the transducer.

In accordance with the invention, magnet pair 839 and 841 are separated by an air gap or non-magnetic spacer 883. Spacer 883 is approximately ⅛ inch in thickness and helps to shape the magnetic field produced by magnets 839–841 which shaping, in turn, helps to keep ribbon 850 physically centered in the gap between the magnets and prevents ribbon 850 from moving in a direction perpendicular to its plane out of the magnetic field.

Attached to side member 886 are also two magnet sets 844 and 853 arranged in a similar fashion to magnets 839 and 841 with the exception that the poles of opposite polarity face ribbon 850. Magnets 844 and 853 are separated by a non-magnetic spacer 876 as previously described to provide magnetic field centering of ribbon 850.

In the final assembly of the speaker, two wooden strips with rounded corners (not shown) are mounted on the lateral faces of the magnets to provide anti-diffraction exit shapes which minimize the effects of diffraction which can occur at any sharp corners located in the vicinity of sound-generating ribbon 850.

In addition, in accordance with the invention, a pair of flat ribbon conductors 840, 842 comprised of Mylar-coated aluminum foil are cemented to the faces of magnets 839, 841 and 844, 853, respectively. Aluminum conductors 840 and 842 provide a return path for the audio-frequency current flowing through ribbon 850. In particular, current flows through ribbon 850 and is split between conductors 840 and 842 and flows back up along the magnet faces to the power source. Current flow in conductors 840 and 842 provides for an electromagnetic force to aid in physical centering of ribbon 850 in a direction parallel to its plane and prevent ribbon 850 from touching the magnet faces.

Figure 9:
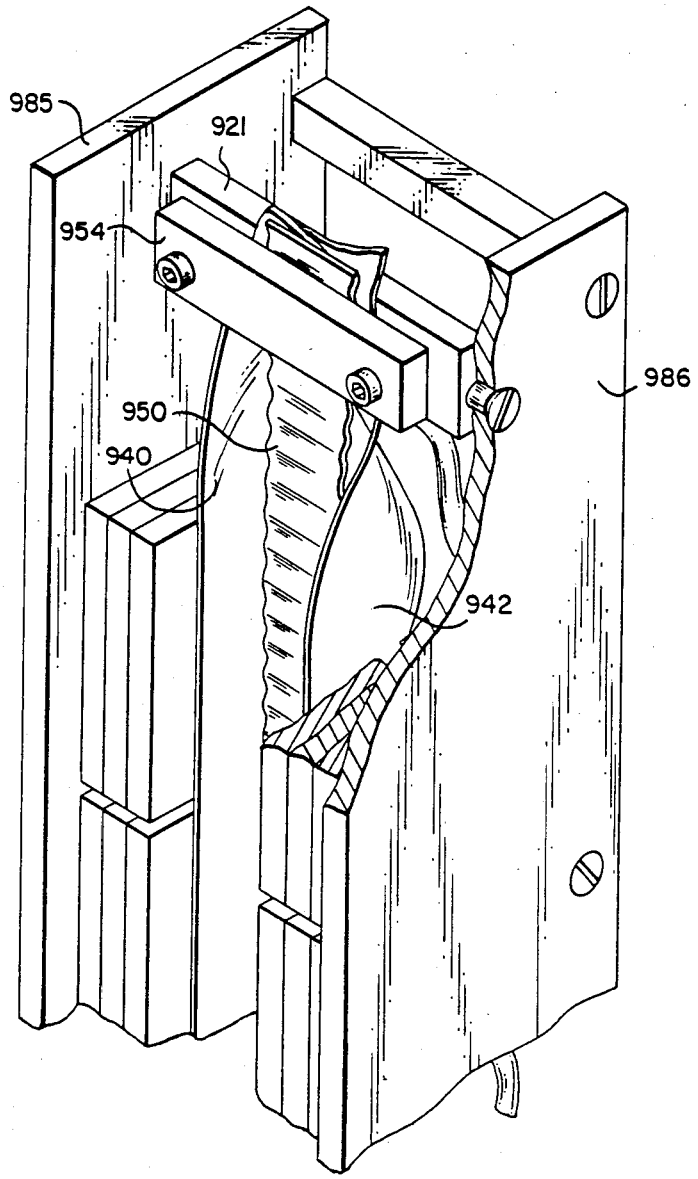
FIG. 9 is an isometric sectional view of the upper end of the tweeter transducer showing the attachment of the ribbon.

FIG. 9 shows an illustrative method of attaching the top end of the tweeter ribbon element to its respective frame members. An insulating bracket 921 with an approximately ½-inch square cross-section is mounted between the side plates 985 and 986. The sound generating ribbon, 950, is held between bracket 921 and a copper bus bar 954 which is bolted to the bracket. At the upper end of the tweeter element the conductors 940 and 942 are also electrically connected to ribbon 950 and held by bus bar 954.

Figure 10:
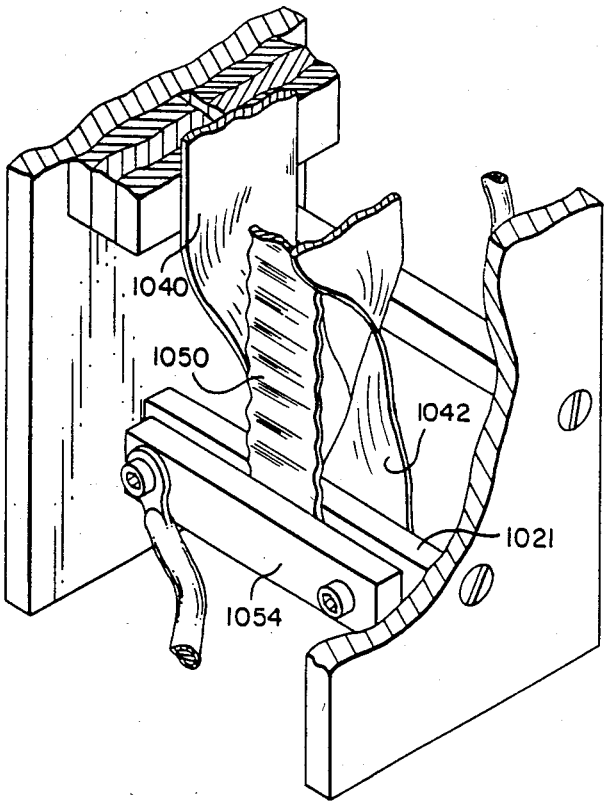
FIG. 10 is an isometric sectional view of the lower end of the tweeter transducer showing the attachment of the ribbon.

FIG. 10 shows an illustrative method of attaching the bottom end of the tweeter ribbon element to its respective frame members. As with the top end, an insulating bracket 1021 is used. However, the ribbon 1050 is mounted on one side of bracket 1021 by bus bar 1054 and conductors 1040 and 1042 are mounted on the opposite side to prevent a short circuit across the speaker. The audio drive is connected between bus bar 1054 and conductors 1040 and 1042.

An alternative embodiment of the inventive ribbon speaker system incorporates a "line source" tweeter transducer —the woofer and mid-range elements remain unchanged as previously described. The alternative tweeter transducer is implemented by mounting a second tweeter ribbon of the same size and characteristics as previously described with the first embodiment above, approximately ⅝ inch forward of the tweeter ribbon shown in FIGS. 8–10. The supporting structure and magnet arrangement remain the same as with the previous embodiments. The method of mounting the second ribbon is the same as previously described, that is, the ribbons may be separated by insulating bars about ⅜ inch thick and clamped by conductive bars such as bar 954 and 1054 shown in FIGS. 9 and 10. As with the single tweeter ribbon and the return current carrying conductor tapes in the previous embodiment, the two tweeter ribbons are electrically connected at one end so that the alternating current which drives the ribbons flows in opposite directions in each ribbon. In addition, the return conductor tapes 940, 942 in FIG. 9 and 1040 and 1042 in FIG. 10 are moved to the front faces 971, 972, respectively, of the magnet sets.

Figure 11:
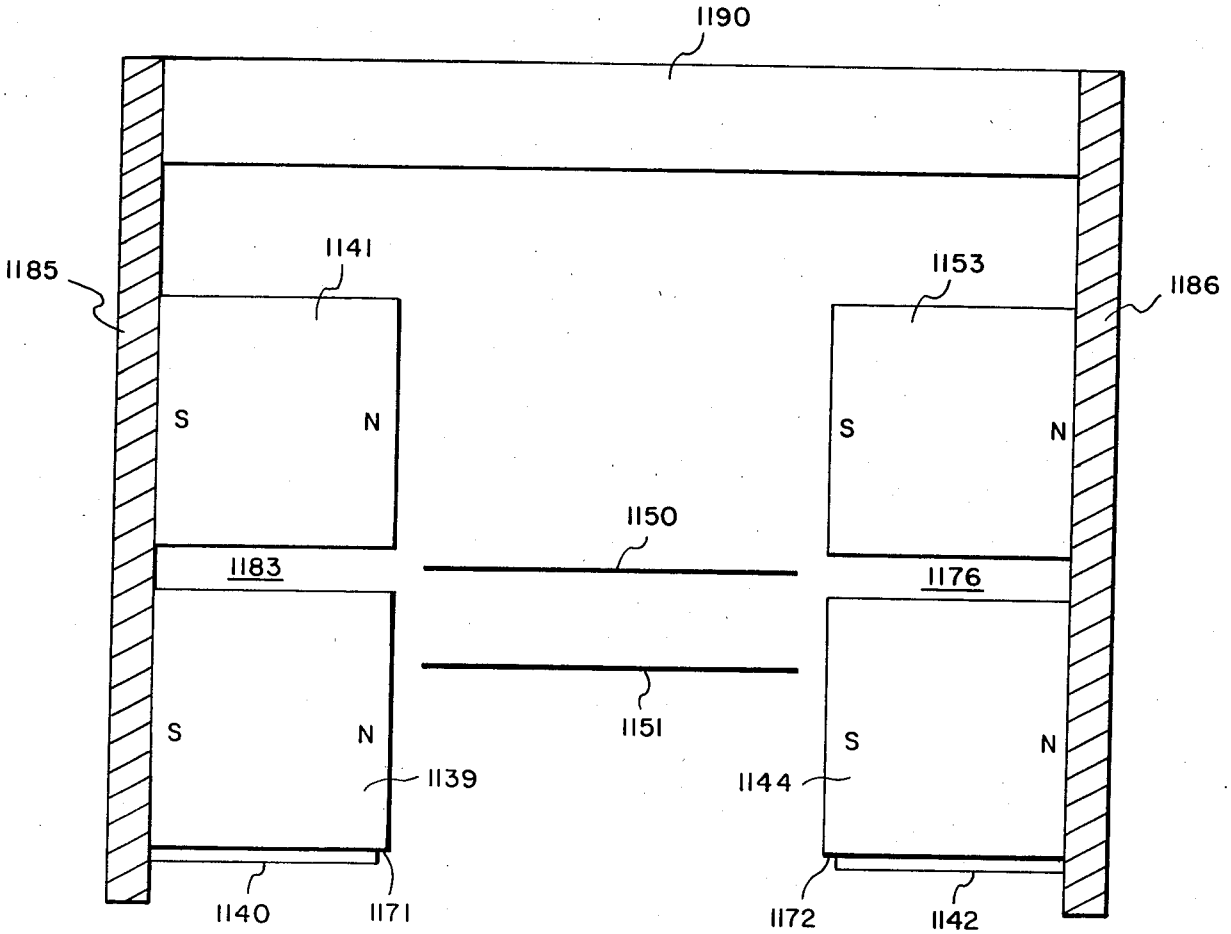
FIG. 11 is a cross-sectional view of an alternative embodiment of the tweeter transducer utilizing dual ribbons.

A cross-section of the alternative embodiment is shown in FIG. 11. This cross-section shows the side plates 1185 and 1186 and the magnet sets 1139, 1141, 1144 and 1153. Also shown are spacers 1183 and 1176 and ribbon 1150. The second ribbon 1151 is arranged in front of ribbon 1150. Conductors 1140 and 1142 have been moved to the front faces (1171 and 1172, respectively) of the magnet sets.

With this alternative embodiment, the acoustical signal radiating from the front and back of the speaker has the same phase and the tweeter acts substantially as a "line source". Acoustical theory states that the highest quality of reproduced sound is achieved by the use of point source or line source speaker systems. Therefore, this alternative embodiment enhances the sound quality generated by the tweeter transducer.

Although only two illustrative embodiments of the invention have been shown here other embodiments within the spirit and scope of this invention will be apparent to those skilled in the art.

What is claimed is:

1. An electromagnetic transducer for reproducing sound vibrations comprising, a non-vibrating frame, a flexible, mechanically-corrugated ribbon comprised entirely of electrically-conducting materials, said ribbon having an elongated shape with a top and a bottom and means for defining a single, serpentine current path in said ribbon from said ribbon top to said ribbon bottom with a plurality of parallel legs having opposing current flow directions therebetween, means for attaching said ribbon to said frame, means for applying tension across said ribbon, and means for establishing a magnetic field in the vicinity of said ribbon, said magnetic field interacting with the current in said ribbon to cause audio-frequency vibrations of said ribbon.

2. The transducer according to claim 1 wherein said current path defining means comprises a plurality of first slots, each of said first slots extending partially across the width of said ribbon from a first edge and a plurality of second slots extending partially across the width of said ribbon from an opposing edge, said second slots being interspersed with said first slots.

3. The transducer according to claim 1 wherein said magnetic field establishing means comprises an array of magnets arranged in rows, each magnet in said array having a magnetic axis perpendicular to said ribbon, the magnets in each of said array rows being arranged in alternating polarity

4. The transducer according to claim 3 wherein said magnets are permanent magnets.

5. The transducer according to claim 1 wherein said ribbon has a trapezoidal shape.

6. The transducer according to claim 1 wherein said tension applying means further comprises means for tensioning said ribbon in a direction parallel to said current flow directions.

7. The transducer according to claim 6 wherein said ribbon is mechanically corrugated in a direction parallel to said current flow direction.

8. An electromagnetic transducer for reproducing sound comprising a rigid supporting frame, an elongated, narrow, planar electrically-conductive ribbon, means to generate a magnetic field in the vicinity of said ribbon, and means for shaping said magnetic field in a direction perpendicular to the plane of said ribbon so that the magnetic field intensity increases in a direction perpendicular to the plane of said ribbon on either side of the ribbon center position.

9. An electromagnetic transducer according to claim 8 wherein said shaping means comprises a pair of magnets aligned in parallel fashion with corresponding pole positions and a non-magnetic spacer located between said magnets at said ribbon center position in the same plane as said ribbon.

10. An electromagnetic transducer according to claim 8 further comprising means to generate an electromagnetic field to center said ribbon in a direction parallel to its plane.

11. An electromagnetic transducer according to claim 10 wherein said field generating means comprises electrical conductors located on both sides of said ribbon and positioned in planes perpendicular to the plane of said ribbon.

12. An electromagnetic transducer according to claim 10 wherein said shaping means comprises a pair of magnets aligned in parallel fashion with corresponding pole positions and a non-magnetic spacer located between said magnets at said ribbon center position in the same plane as said ribbon.

13. An electromagnetic transducer for reproducing sound vibrations comprising, a non-vibrating frame, an elongated, narrow, planar electrically-conductive ribbon having a top and bottom and being mechanically corrugated in a direction at an angle to its length, means for attaching said top and said bottom to said frame, means for establishing a magnetic field in the vicinity of said ribbon, said magnetic field interacting with the current in said ribbon to cause audio-frequency vibrations of said ribbon, and means for attaching the sides of said ribbon to said means for establishing said magnetic field.

14. An electromagnetic transducer according to claim 13 further comprising means for shaping said magnetic field in a direction perpendicular to the plane of said ribbon so that the magnetic field intensity increases in a direction perpendicular to the plane of said ribbon on either side of the ribbon center position.

15. An electromagnetic transducer according to claim 13 wherein the angle of said corrugations in said ribbon varies along its length.

16. An electromagnetic transducer according to claim 15 further comprising a pair of strips having rounded edges mounted on said means to establish said magnetic field in order to prevent sound diffraction on the edges of said means to establish said magnetic field.

17. An electromagnetic transducer according to claim 16 further comprising a pair of acoustic foam strips for attaching the sides of said ribbon to said anti-diffraction strips.

18. An electromagnetic transducer according to claim 17 wherein said means for establishing said magnetic field comprises a an elongated frame having a pair of elongated sideplates composed of magnetic material, at least one cross piece for holding said sideplates parallel to each other and spaced apart by a fixed distance and at least one magnet mounted on each of said sideplates.

19. A loudspeaker for reproducing sound vibrations comprising, a non-vibrating frame, a pair of elongated, narrow, planar electrically-conductive ribbons, each having a top and bottom and being mechanically corrugated in a direction perpendicular to its length, means for attaching said top and said bottom of each ribbon to said frame so that said ribbons are mounted in a planes parallel to each other, said ribbons being aligned one directly in front of the other, means for electrically connecting said ribbons so that current in one ribbon flows in the opposite direction to current flow in said other ribbon, and means for driving an alternating current representing sound vibrations through said ribbons, means for establishing a magnetic field in the vicinity of each of said ribbons, said magnetic field interacting with the current in each of said ribbon to cause said ribbons to vibrate in opposite directions so that sound wave emanating from the front of said speaker are in phase with sound waves emanating from the back of said speaker whereby the ribbons act as a true line sound source.

20. An electromagnetic transducer according to claim 19 wherein said ribbons are spaced apart by a constant predetermined distance.

21. An electromagnetic transducer according to claim 20 further comprising means for shaping said magnetic field in a direction perpendicular to the planes of said ribbons so that the magnetic field intensity increases in a direction perpendicular to the planes of said ribbons on either side of the ribbon center position.

22. An electromagnetic transducer for reproducing sound comprising a rigid supporting frame, a pair of elongated, narrow, planar electrically-conductive ribbons mounted in planes parallel to each other, aligned one in front of the other and spaced apart by a constant predetermined distance, means to generate a magnetic field in the vicinity of each of said ribbons, and means to generate an electromagnetic field to center said ribbons in a direction parallel to their planes.

23. An electromagnetic transducer according to claim 22 wherein said field generating means comprises electrical conductors located on both sides of said ribbons and positioned in planes parallel to the planes of said ribbons.

24. An electromagnetic transducer according to claim 23 further comprising means for shaping said magnetic field in a direction perpendicular to the planes of said ribbons so that the magnetic field intensity increases in a direction perpendicular to the planes of said ribbons on either side of the ribbons center position.

25. An electromagnetic transducer according to claim 24 wherein said shaping means comprises a pair of magnets aligned in parallel fashion with the corresponding pole positions and a non-magnetic spacer located between said magnets at said ribbons center position in the same plane as said ribbon planes.

* * * * *